United States Patent [19]

Freydier

[11] 3,946,570

[45] Mar. 30, 1976

[54] SUPPORT AND FOUNDATION COMPOSITE PILE FOR VARIOUS WORKS AND METHOD FOR MANUFACTURING THE SAME

[75] Inventor: Pierre Henry Freydier, Garches, France

[73] Assignee: S.E.F.I. Sondages-Etanchements-Forages-Injections, Viry-Chatillon, France

[22] Filed: Sept. 27, 1974

[21] Appl. No.: 509,932

[30] Foreign Application Priority Data

Oct. 2, 1973 France ..... 73.35191

[52] U.S. Cl. ..... 61/53.52; 52/166; 61/35; 61/56.5

[51] Int. Cl.[2] ..... E02D 5/38; E02D 5/54

[58] Field of Search ..... 61/53.52, 53.62, 53.6, 61/35, 37, 56.5; 166/224, 187; 52/169, 166

[56] References Cited

UNITED STATES PATENTS

| | | | |
|---|---|---|---|
| 1,279,834 | 9/1918 | Blumenthal | 61/53.62 X |
| 1,501,643 | 7/1924 | Blumenthal et al. | 61/53.62 X |
| 2,025,948 | 12/1935 | Jorgensen | 61/53.6 X |
| 2,924,948 | 2/1960 | Mueller | 61/53.6 X |
| 3,309,878 | 3/1967 | Lamberton | 61/53.62 |
| 3,494,134 | 2/1970 | Jorge | 61/53.6 X |
| 3,496,729 | 2/1970 | Pleuger | 61/53.62 X |
| 3,842,608 | 10/1974 | Turzillo | 61/53.52 |
| 3,855,804 | 12/1974 | Herbst et al. | 61/53.6 |

*Primary Examiner*—Dennis L. Taylor
*Attorney, Agent, or Firm*—Hauke, Patalidis & Dumont

[57] ABSTRACT

The pile comprises a strainer tube connected through a sealing grout to a reinforcement part inside said tube which is held in the surrounding ground by injections of an anchorage grout and by injections of a tightening grout.

9 Claims, 7 Drawing Figures

SUPPORT AND FOUNDATION COMPOSITE PILE FOR VARIOUS WORKS AND METHOD FOR MANUFACTURING THE SAME

This invention relates to means embodied for the support of works which are either built or under construction and which cannot be directly supported by the ground.

To solve the above mentioned problem, it is usual to make pits in the grounds in which are raised or built piles made of reinforced concrete or bodies of foundation in conventional masonry. Such a method enables to realize a strong support ensuring a good steadiness to the work to be realized or strengthened. But it shows a number of disadvantages. In fact, when the work to be supported causes a small overlead to the ground unit area, the piles or bodies require superabundant foundations and consequently are very expensive. On the other hand, such a construction does not provide to realize piles or foundation bodies of small sizes. It is thus not possible to realize a foundation of a semi-continuous type, comprising close supporting points having a small supporting surface.

Another disadvantage lies in the fact that in many cases, it is not possible to realize conventional piles or foundations because of difficulties to access to the work sites. Actually obstructions on the work sites or also the presence of obstacles, either overhead or buried in the ground, reduce the available area for the management of the works.

This invention copes with the above mentioned by creating a new support and foundation pile which can be made and embodied in a very short period of time on a work site without requiring to bring very heavy materials or to cause an important obstruction.

According to this invention, the composite pile is characterized in that it comprises a strainer tube made of steel and connected by a sealing grout to a reinforcement part also made of steel and provided inside said tube which is held in the surrounding ground by injections of an anchor grout made in superposed zones on the lower portion of the tube located in a so-called good ground and by securing or cohesion injections performed at level of the upper portion of the tube located in a so-called poor ground, said tube forming, with the reinforcement part and the sealing grout, an anchor head protruding from the ground and provided to be fixed to the work to be supported by said pile.

This invention also relates to a method for the manufacture of a pile on a work site.

Various other features of this invention are moreover shown in the following detailed description.

Embodiments of this invention are shown by way of non-restrictive examples in the accompanying drawings, in which.

Figure 2:
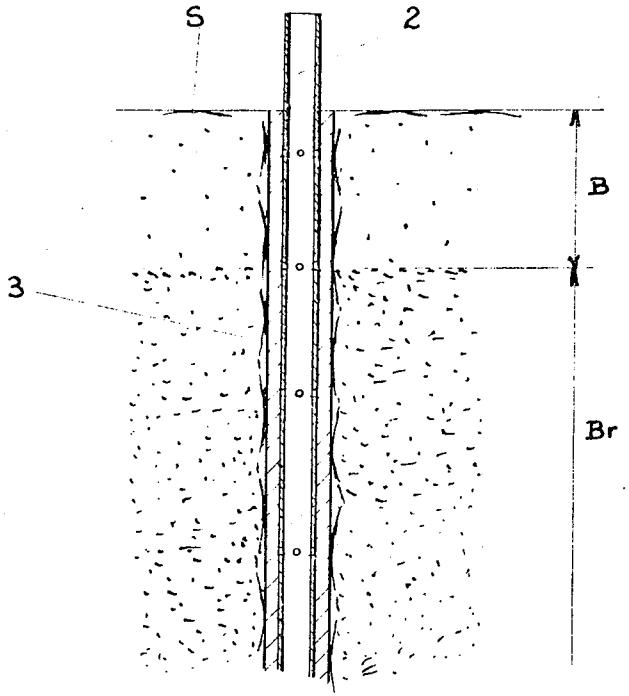
FIGS. 1 – 4 are sectional-elevation views showing different steps of a manufacturing method according to this invention.
Figure 1:
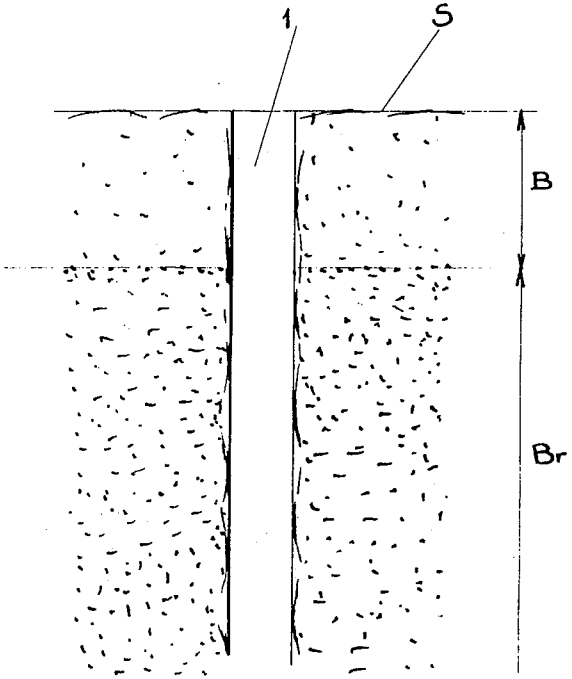

FIGS. 1 – 4 show a first example of manufacturing a pile according to this invention, and provided to form, in cooperation with other similar piles, the foundations of a work having to be built on a ground S whose underground comprises a bed B of an unsteady nature and without any cohesion which cannot ensure a good supporting surface for a work to be made thereupon. According to a first step of the manufacturing method, a boring 1 is made into the ground S and is preferably made with a dry drill, i.e. without any injection of boring fluid, to pass through the bed B having a poor support and extend on a sufficient depth inside the strong bed $B_r$ or a strong cohesion subjacent to bed B. Then a strainer tube 2 is placed in the boring 1, as shown in FIG. 2, said tube 2 having a diameter smaller than that of the boring but a length higher than the depth of the boring. The strainer tube 2 is then held inside the boring 1 by means of a grout 3 to provide a kind of sheath for example formed with a base of concrete, to constitute after its hardening a covering establishing a good connection between the tube 2 and the peripheral wall of the boring 1 and preventing any raise of grout during further injections.

Figure 3:
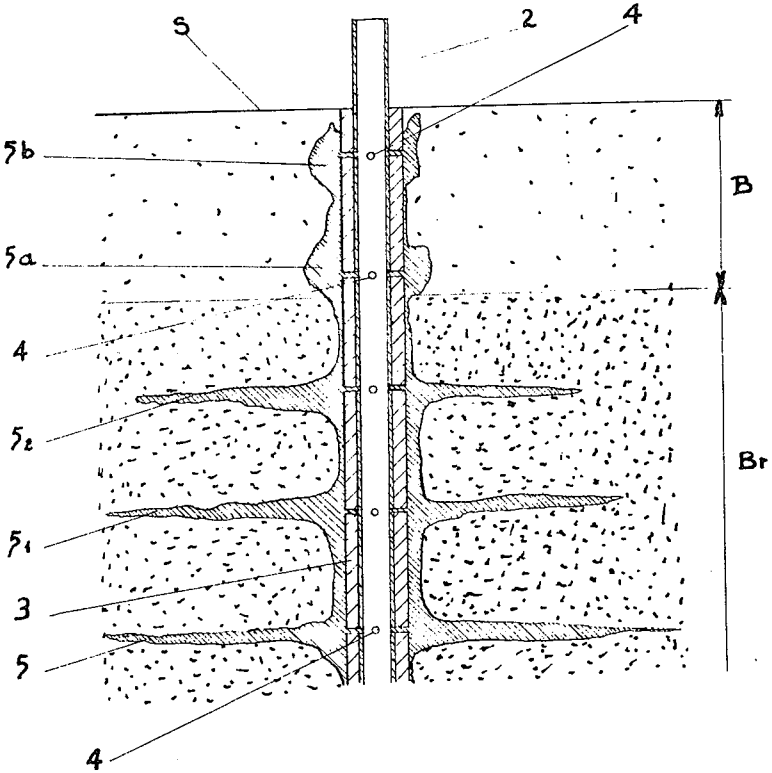

FIG. 3 shows another step of construction, in which an injection stick is used to provide a closer connection between the strainer tube 2, the sheath grout 3 and the surrounding ground. Although not shown, the stick comprises an injection rod to delimit, after its introduction into the strainer tube 2, a tight annular cell able to be brought in coincidence successively with series of radial holes 4 made according to regularly spaced transverse planes, in the strainer tube 2. According to a preferred embodiment, the tip of the injection stick is introduced into the strainer tube 2 to be placed at a level of the lower series of holes 4, so to realize an injection 5 of concrete or other suitable material delivered at a pressure depending on the vertical load supported by the zone of ground to be passed through and also on the nature of said ground. Concrete is thus brought to pass through the various holes 4, and then to perforate the sheath grout 3 before being spread in the surrounding ground of the strong bed $B_r$ according to a radial influence zone of a low thickness surrounding the boring 1. The process is the same for each of the series of holes 4 corresponding to the strong bed $B_r$ in order to realize anchor injections ensuring a strong connection between the surrounding ground, the sheath grout 3 and the tube 2. In the example illustrated in FIG. 3, are made three similar injections $5 - 5_1 - 5_2$, but it is obvious that any other number of injections can be made depending on the penetration depth of the boring 1.

A second step of the same stage of the construction method consists then of realizing — at a level of the series of holes 4 corresponding to the bed of ground B having a poor support — an injection 5*a* – 5*b* of a filling grout of concrete or other suitable material under low pressure ensuring a tightening or cohesion effect in view of filling the inner gaps existing between the constituents of the grounds. Such a step of the method thus provides the peripheral zone of the bed B surrounding the sheath grout 3 with a good cohesion between the various materials or constituents of the surrounding ground and thus establishes on the whole height of the boring 1 a strong holding of the sheath grout 3 and of tube 2.

Figure 4:
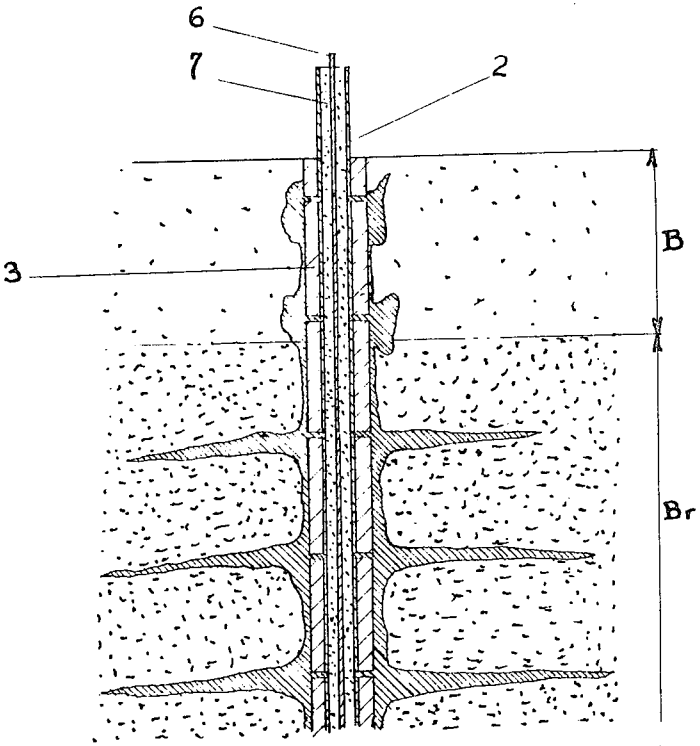

FIG. 4 shows another step of the method according to which a reinforcement 6 is placed inside the strainer tube 2, which reinforcement 6 can be constituted by one or several metal bars. The reinforcement 6 is connected to the strainer tube 2 through a sealing grout 7 brought to fill the annular volume between the reinforcement 6 and the peripheral inner wall of the strainer tube 2.

After hardening of the various successive grouts there is then obtained a composite pile of which the main constituting elements contributing to the support of a load are formed by the reinforcement 6 and the strainer tube 2 connected together by the sealing grout 7 which are held without any risk of bending by the outer sheath grout 3 and also by the surrounding ground on which the pile is held by the anchor injections 5 – $5_1$ – $5_2$ and by the tightening injections 5*a* – 5*b*.

Figure 5:
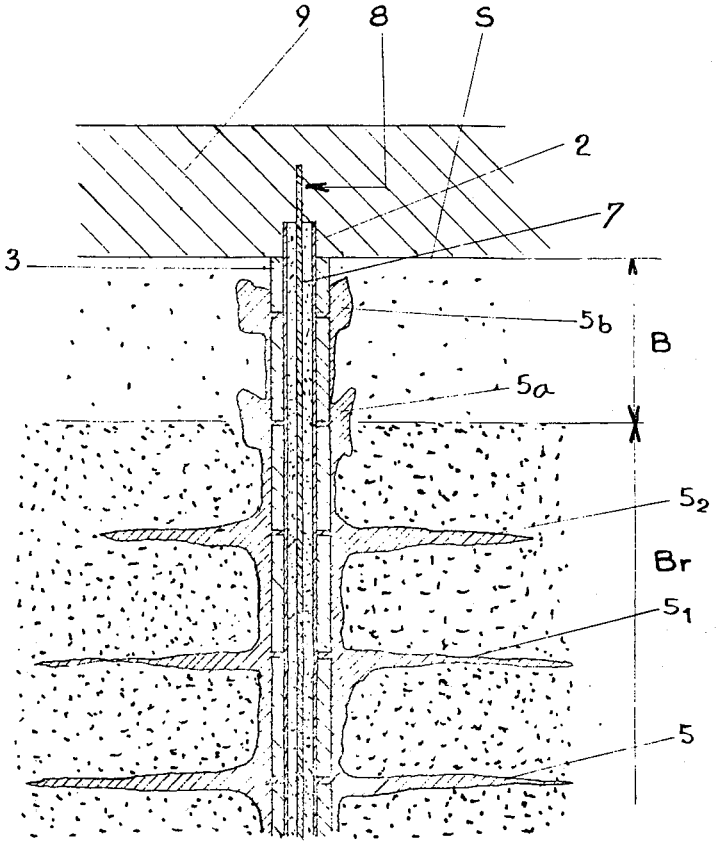
FIG. 5 is a sectional-elevation view illustrating a finished composite pile.

The final step of the method consists then of preparing the upper portion of the strainer tube 2 and reinforcement 6 protruding from the ground S, in view of forming a head 8 (FIG. 5) designed to be embedded in or fixed by any suitable means to a work 9 directly realized on the ground S.

As appears from the above description, the composite pile according to this invention can be quickly made on a worksite without the necessity of using heavy complex and expensive installations or materials. The method provides a composite pile supporing without any risk of bending, a very heavy stress or constraint to compression, since the various constituting elements are placed concentrically and held relatively one in relation with the others. Thus it is possible to realize close anchorage and foundation points having a small capacity to support for example a fragile work which could not stand the stresses or torque moments normally imposed by spaced bearing points having a greater capacity. It is also possible to constitute foundations corresponding exactly to the load of a work to be supported and consequently to reduce the cost of such a foundation comparatively to that resulting from the embodiment of conventional foundations. This invention has another advantage in that the construction of the composite pile requires only a small surface on the ground, which enables to make strong supports or strong foundations even in the cases where the worksites are difficult of access or in the case where obstacles are buried in the ground.

Figure 7:
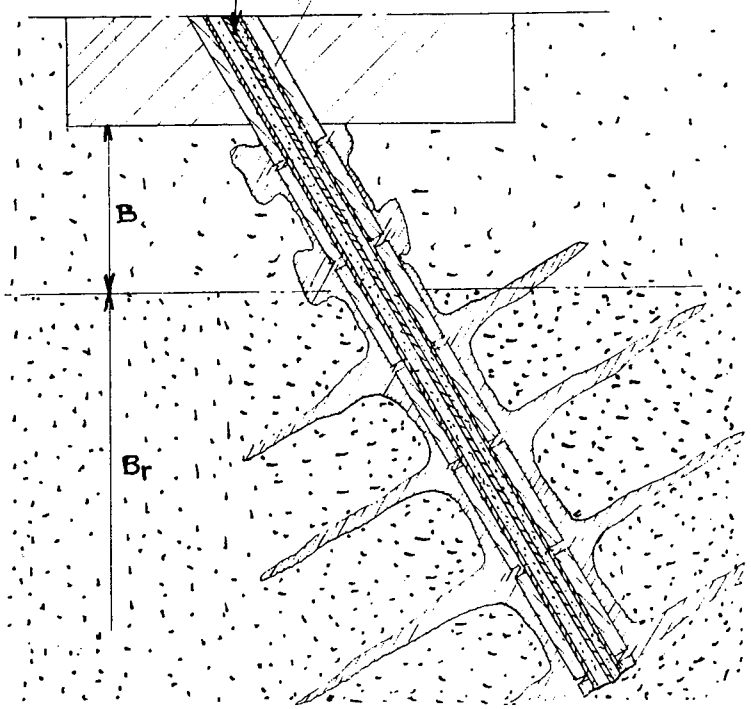
FIGS. 6 and 7 are two sectional-elevation views showing a variant of manufacturing the pile.
Figure 6:
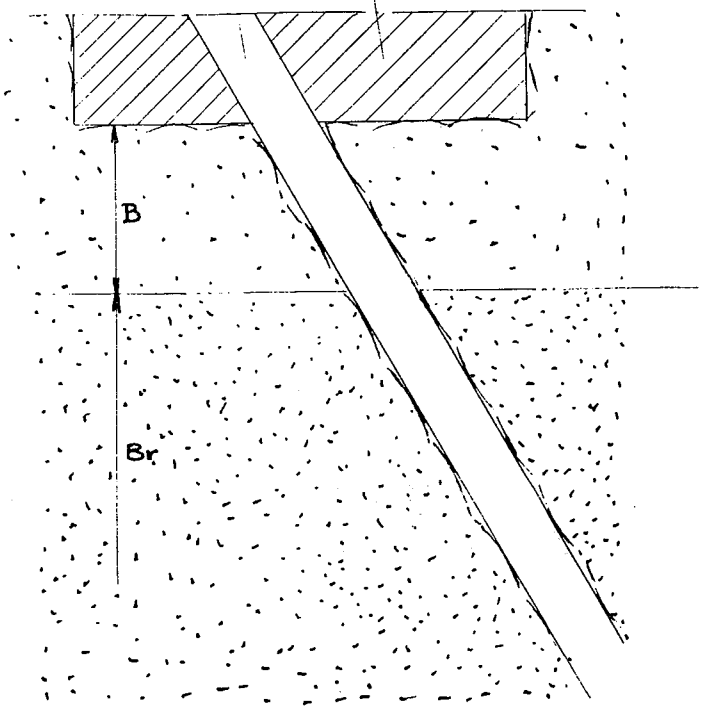

In the first example of embodiment, the work 9 is built on the heads 8 of the various composite piles which ensure its support with respect to a bed B of a poor support. It is noted that the method of this invention can be embodied with the same advantage in the case where it becomes difficult to complete or to ensure the support or the foundation of a work already built and which it is necessary to protect against any slide or collapse of the supporting ground. In such a case represented in FIGS. 6 and 7, first is made a boring 1*a* in such a way to pass through the foundation 10 of a work directly or indirectly bearing on the bed B having a poor support. The boring 1*a* is made as previously described to pass through the bed B of poor support and reach on a sufficient depth the strong ground or bed $B_r$. Then are performed the subsequent operations such as described in the first embodiment in view of realizing the composite pile whose head 8 is then fixed to the foundation 10 of the built work, for example by means of an expansive grout mortar 11 introduced in the space provided by the head 8 and the boring made in the foundation 10.

In the above described embodiment, the boring 1*a* is made at an angle to the vertical to ensure a suitable support or anchorage of a construction already realized. It is obvious that it would be possible to obtain the same result in making a vertical boring 1*a*. Also, and according to cases, the borings 1 of the example according to FIGS. 1 – 5 can also be inclined of a value which may be similar or different for all the composite piles of a same foundation or support work.

Although not shown, the pile can be made by proceeding directly to the driving of the strainer tube 2 into the ground. In such a case the connection between the strainer tube and the surrounding ground is provided by the anchorage injections 5 – 5*n* and tightening injections 5*a* – 5*x* possibly made after an impregnation operation of the surrounding ground on a short influence distance by means of a filling or cohesion grout spread in the ground through the series of holes 4.

The invention is not restricted to the embodiments shown and described in detail, for various modifications thereof can moreover be applied thereto without departing from the scope of the invention as shown in the appended claims.

I claim:

1. A method for manufacturing a composite pile for supporting a construction on the surface of the ground comprising the steps of boring the ground to a depth sufficient to reach and penetrate into a coherent and strong bed, introducing into the bore a strainer tube of a diameter smaller than that of said bore, connecting said tube to the bore through an injection of sheath grout, connecting said tube and said sheath grout to the surrounding ground through superposed injections of an anchor grout made on the lower portion of the tube and sheath grout located in the good ground and by at least one injection of a cohesion grout impregnating the upper bed of the surrounding ground, said injections being made through injection holes disposed in said strainer tube, placing a reinforcement part inside said tube, introducing in said tube a sealing grout for the reinforcement part, and forming the end portion of the tube, of the reinforcement part and the sealing grout raising above the ground to provide an anchorage head to be affixed to the construction to be supported.

2. Method as set forth in claim 1, wherein said boring is made in the foundation of a work already built.

3. Method as set forth in claim 1 wherein said boring is substantially vertical.

4. Method as set forth in claim 1 wherein said boring is at an angle to the vertical.

5. A support and foundation composite pile for supporting a construction on the surface of the ground comprising a strainer tube made of steel disposed in a bore in the ground having a diameter larger than that of said strainer tube, a sheath grout peripherally disposed around said strainer tube and filling the space between said strainer tube and the wall of said bore, an anchoring grout injected at diverse levels into the surrounding ground through injection holes disposed in said strainer tube at the lower portion of said tube, a reinforcement part disposed in said tube, a sealing grout sealing the space between the inner wall of said tube and said reinforcement part, and an anchor head protruding from the ground and adapted to be affixed to the construction supported by said composite pile, said anchor head being provided by the protruding portion of said strainer tube, sealing grout and reinforcement part.

6. The support and foundation composite pile of claim 5 further comprising securing and cohesion injections of grout disposed at superimposed levels at the upper portion of said tube and effected through said injection holes.

7. The support and foundation composite pile of claim 5 wherein said strainer tube is disposed substantially vertically.

8. The support and foundation composite pile of claim 5 wherein said strainer tube is disposed at an angle to the vertical.

9. The support and foundation composite pile of claim 5 wherein said bore is formed partly through the foundation of a work already built and said anchor head is affixed to said work.

* * * * *